US006760952B1

(12) United States Patent
Stegens

(10) Patent No.: US 6,760,952 B1
(45) Date of Patent: Jul. 13, 2004

(54) VACUUM CLEANER BRUSHROLL

(75) Inventor: Alfred H. Stegens, Olmsted Township, OH (US)

(73) Assignee: The Scott Fetzer Company, Westlake, OH (US)

( * ) Notice: Subject to any disclaimer, the term of this patent is extended or adjusted under 35 U.S.C. 154(b) by 0 days.

(21) Appl. No.: 10/601,160

(22) Filed: Jun. 20, 2003

(51) Int. Cl.[7] ..... A47L 9/04
(52) U.S. Cl. ..... 15/383; 15/366; 15/41.1
(58) Field of Search ..... 15/383, 41.1, 179, 15/182, 366

(56) References Cited

U.S. PATENT DOCUMENTS

| | | | | |
|---|---|---|---|---|
| 293,989 | A | 2/1884 | Travis | |
| 395,362 | A | 1/1889 | Spangenberg | |
| 455,017 | A | 6/1891 | Hothersall | |
| 606,248 | A | 6/1898 | Smith | |
| 1,044,488 | A | 11/1912 | Case | |
| 1,624,247 | A | 4/1927 | Hoover | |
| 1,718,302 | A | 6/1929 | Nulsen | |
| 1,922,752 | A | 8/1933 | Vogler | |
| 1,942,497 | A | 1/1934 | Smellie | |
| 2,045,270 | A | 6/1936 | Hoover | |
| 2,135,885 | A | 11/1938 | Dow | |
| 2,140,651 | A | 12/1938 | Riebel, Jr. et al. | |
| 2,271,545 | A | 2/1942 | Cummings | |
| 2,271,554 | A | 2/1942 | Smellie | |
| 2,271,555 | A | 2/1942 | Gerber et al. | |
| 2,271,556 | A | 2/1942 | Boyle et al. | |
| 2,459,007 | A | 1/1949 | Taylor | |
| 2,659,921 | A | 11/1953 | Osborn | |
| 2,790,985 | A | 5/1957 | Harlan | |
| 3,181,193 | A | 5/1965 | Nobles et al. | |
| 3,457,575 | A | 7/1969 | Bienek | |
| 3,482,276 | A | 12/1969 | Fillery | |
| 3,716,889 | A | 2/1973 | Goldstein | 15/366 |
| 3,828,387 | A | 8/1974 | Liebscher | |
| 3,959,847 | A | 6/1976 | Kaulig et al. | |
| 4,173,807 | A | 11/1979 | Maier | 15/179 |
| 4,307,479 | A | 12/1981 | Mertes et al. | 15/182 |
| 4,349,936 | A | 9/1982 | Lorson et al. | 15/366 |
| 4,357,727 | A | 11/1982 | McDowell | |
| 4,372,004 | A | 2/1983 | Vermillion | 15/182 |
| 4,429,430 | A | 2/1984 | Lyman | 15/182 |
| 4,498,214 | A | 2/1985 | Oxel | 15/320 |
| 4,720,891 | A | 1/1988 | Rennecker et al. | 15/371 |
| 4,912,805 | A | 4/1990 | Krasznai et al. | 15/392 |
| 4,955,102 | A | 9/1990 | Cousins | 15/182 |
| 5,003,663 | A | 4/1991 | Sunagawa et al. | 15/366 |
| 5,272,785 | A | 12/1993 | Stegens | 15/179 |
| 5,452,490 | A | 9/1995 | Brundula et al. | 15/182 |
| 5,481,781 | A | 1/1996 | Weber | 15/378 |
| 5,495,634 | A | 3/1996 | Brundula et al. | 15/182 |
| D398,096 | S | 9/1998 | Gildersleeve | D32/22 |
| 6,021,545 | A | 2/2000 | Delgado et al. | 15/322 |
| 6,094,776 | A | 8/2000 | Fish | 15/398 |
| 6,125,495 | A | 10/2000 | Berg et al. | 15/183 |
| 6,324,714 | B1 | 12/2001 | Walz et al. | 15/52.1 |
| 6,449,793 | B2 * | 9/2002 | D'Costa et al. | 15/179 |
| 6,530,106 | B1 * | 3/2003 | Brundula | 15/182 |
| 6,574,823 | B1 | 6/2003 | Stegens | 15/182 |
| 6,591,440 | B2 | 7/2003 | Stegens et al. | 15/179 |
| 6,591,441 | B2 | 7/2003 | Stegens et al. | 15/179 |

* cited by examiner

*Primary Examiner*—Theresa T. Snider
(74) *Attorney, Agent, or Firm*—Pearne & Gordon LLP

(57) ABSTRACT

A vacuum cleaner brushroll characterized by a bristle tufted arrangement that forms multiple dwell positions around the brushroll. In each dwell position, the majority of bristle tufts along the length of the spindle are out of sweeping contact with the carpet which allows the carpet to drawn upwardly toward the mouth of the vacuum cleaner nozzle. The up and down carpet movement that occurs during brushroll rotation enhances its cleaning performance.

12 Claims, 6 Drawing Sheets

VACUUM CLEANER BRUSHROLL

FIELD OF INVENTION

The present invention relates to generally to vacuum cleaner brushrolls, and, more specifically, to vacuum cleaner brushrolls having new and improved bristle tuft pattern that enhances the performance of the brushroll.

BACKGROUND

The typical vacuum cleaner brushroll includes a spindle that carries rows of bristle tufts which sweep across the carpet during rotation of the brushroll. Conventional brushrolls have the bristle tufts arranged to provide a sweeping contact with the carpet along the length of the brushroll in every rotative position. The rows may be parallel to the longitudinal axis of the spindle as disclosed in U.S. Pat. No. 3,828,387 to Liebsher or they maybe helically oriented as disclosed in U.S. Pat. No. 4,387,479 to Mertes and U.S. Pat. No. 6,530,106 to Brundula.

As shown in both the Mertes and the Brundula patents, the rows of bristle tufts may extend in the same helical direction from one end of the spindle to the other or they may form reverse helixes. In certain embodiments of the Brundula patent, the helical rows are made up of tufted segments that are parallel to the axis of the spindle. In other embodiments, the tufted segments are helically oriented. In either case, the helical twist is large, for example, 760°, in order to ensure bristle contact with the carpet along the length of the spindle.

SUMMARY OF THE INVENTION

The present invention provides a new and improved vacuum cleaner brushroll characterized by a bristle tuft pattern that promotes an up and down movement of the carpet during rotation of the brushroll. The unique up and down motion of the carpet that occurs during rotation significantly enhances the cleaning performance of the brushroll.

As used herein the term "row" means a grouping of aligned bristle tufts on a helix.

The term "section" means a portion of the brushroll defined by rows of bristle tufts that are rotationally or angularly spaced from the rows of adjacent brushroll sections.

The term "dwell position" means a position of brushroll rotation in which the rows of bristle tufts along at least one-half the length of the brushroll are not in sweeping contact with the carpet. In a dwell position, the portion of the carpet out of sweeping contact by the bristles will be drawn up toward the mouth of the sweeper nozzle to produce an up and down wave motion of the carpet during brushroll rotation that improves the cleanability performance of the brushroll.

The term "helix rotation" means the helical twist of a row of bristle tufts about the longitudinal axis of the brushroll.

In accordance with the invention, the new brushroll comprises a spindle having first and second ends and a longitudinal axis of rotation, and rows of bristle tufts arranged in sections along the length of the spindle with the rows of each section being rotationally or angularly spaced from the rows of adjacent sections. The orientation of the rows of each section and the rotational spacing between rows of adjacent sections form multiple dwell positions during each 360° of brushroll rotation.

The brushroll can have from three to eight sections. The number of rows of tufts in each section can vary, but the most effective dwell positions occur with two rows in each section. The rotative or angular spacing between two rows in a section can range from 160° to 200°, with the most preferred spacing being 180° so that the two rows are diametrically opposed.

The rotational or angular spacing between the rows of tufts of adjacent sections can also vary. According to one embodiment of the invention, the rows of tufts are helically oriented and extend in the same helix direction. In this embodiment, the helix rotation of the rows and the rotational spacing between the last tufts of one section and the first tufts of the adjacent section form a dwell position extending the length of the brushroll every 90° of rotation. In another embodiment, the rows of tufts along one-half of the brushroll extend in one helix direction, while the rows of tufts along the other one-half of the brushroll extend in a reverse helix direction. The helix rotation of the rows and the rotational spacing between the last end tufts of one section and the first end tufts of the adjacent section form a dwell position along one-half the brushroll length every 90° of rotation.

A fuller understanding of the invention will be had from the following detailed description of its embodiments and the accompanying drawings.

DESCRIPTION OF PREFERRED EMBODIMENTS

Figure 1:
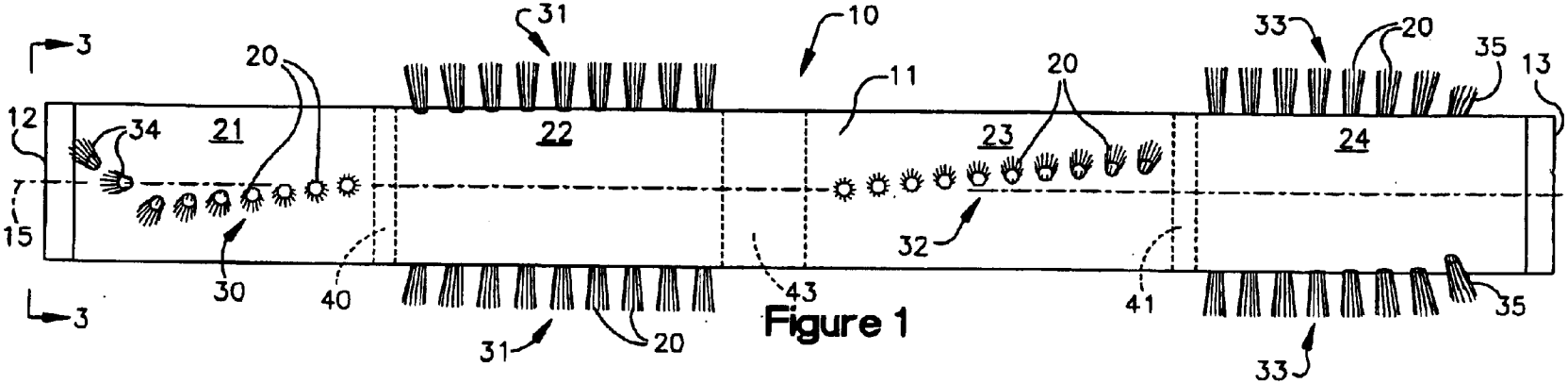
FIG. 1 is a plan view of one embodiment of the invention.

Referring now to the drawings, and to the embodiment of FIGS. 1–6 in particular, a brushroll according to one embodiment of the invention is generally indicated by reference numeral 10. The brushroll 10 includes a spindle 11 having first and second ends 12, 13, respectively, and a longitudinal axis of rotation 15. Bristle tufts 20 on the spindle 11 are arranged in quadrants 21, 22, 23 and 24 along the length of the spindle. The locations of the bristle tufts 20 are represented by circles in the schematic layout of FIG. 2 which shows the brushroll 10 in an unrolled condition.

The bristle tufts 20 in each quadrant 21–24 are arranged in two helically oriented rows of rotationally opposed tufts spaced 180° apart. The rows in each section 21–24 are helically oriented and each have a helix rotation of about 18° from one end to the other end. The rows in quadrant 21 are designated by reference numeral 30, the rows in quadrant 22 by reference numeral 31, the rows in quadrant 23 by reference numeral 32, and the rows in quadrant 24 by reference numeral 33. Each of the rows 30 has seven tufts, each of the rows 31 has nine tufts, each of the rows 32 has ten tufts, and each of the rows 33 has seven tufts. There are two reversely angled tufts 34 at the ends of each row 30 adjacent the end 12 and an offset tuft 35 adjacent each end of the rows 33 near the end 13. The tufts 34, 35 are conventional and serve to inhibit threads and other debris from entering the bearings (not shown) of the brushroll during use.

Figure 2:
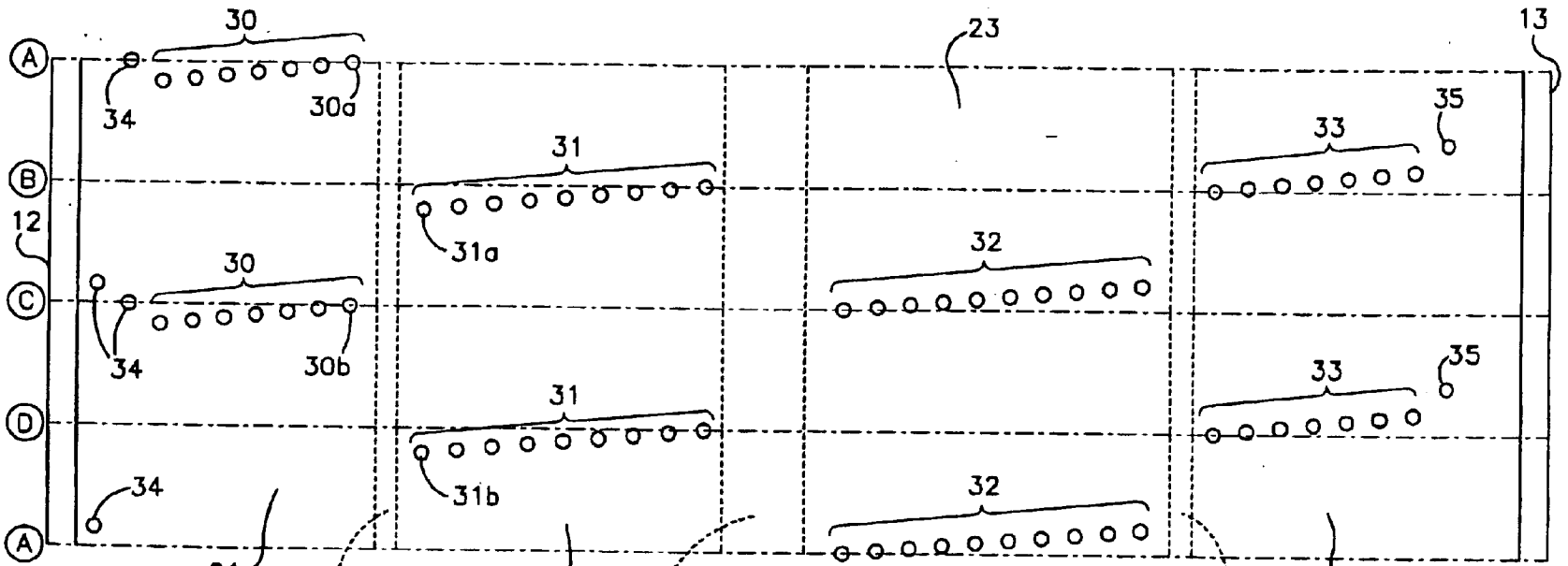
FIG. 2 is a schematic layout of the embodiment of FIG. 1. in an unrolled condition.

It will be seen from FIGS. 1 and 2 that the rows of tufts in each of the quadrants 21–24 are rotationally spaced from the rows of adjacent sections. As shown most clearly in FIG. 2, beginning at the end 12 of the brushroll 10 and continuing towards the other end 13, the first tuft 31*a* of one row 31 is rotationally spaced about 108° from the last tuft 30*a* of one row 30 and about 72° from the last tuft 30*b* of the other row 30. Similarly, the first tuft 31*b* of the other row 31 is rotationally spaced about 108° from the last tuft 30*b* and about 72° from the last tuft 30*a*. The last tufts of rows 31 in quadrant 22 are each rotationally spaced about 90° from the first tufts of rows 32 in quadrant 23. The last tufts in rows 32 are spaced from the first tufts in rows 33 in the same manner as the spacing between rows 30, 31.

If desired, the quadrants 21–24 may be spaced apart axially of the brushroll 10 in order to accommodate cord savers and a belt guard. Some vacuum sweepers have sole plates provided with transverse strips or bars extending from one side of the nozzle opening to the other in order to prevent the sweeper cord from wrapping around the spindle during use. Sweepers may also have a pulley belt guard in the form of a plate extending transversely across the nozzle from one side to the other. As illustrated in FIGS. 1 and 2, the adjacent end tufts of rows 30, 31 in quadrants 21, 22 are spaced apart axially of the spindle to accommodate a cord saver indicated by broken line 40. The adjacent end tufts of rows 32, 33 in quadrants 23, 24 are spaced apart to accommodate a cord saver indicated by broken line 41. The adjacent end tufts of rows 31, 32 in quadrants 22, 23 are more widely spaced apart to accommodate a belt guard indicated by broken line 43. It is to be understood that the axial spacing between end tufts of the adjacent quadrants can be eliminated in the case of sweepers which do not have cord savers and/or belt guards.

In FIG. 2, the lines A, B, C and D are parallel to the axis of rotation 15 indicated in FIG. 1. The rows 30, 31, and 32 have a helix rotation of about 18°. The rows 33 have a helix rotation of about 15 Thus, in the illustrated embodiment of FIG. 1, the helix rotation of the rows of tufts varies between 15° to 20°. Those skilled in the art will recognize that amount of helix rotation can vary from the indicated range, and that the invention is not limited to any specific helix rotation. Still referring to FIG. 2, the helix rotation of the rows of tufts and the rotational spacing between the end tufts in rows of adjacent quadrants form four dwell positions 90° apart extending the length of the spindle 11. A first dwell position is between the lines A and B in FIG. 2, a second dwell position is between the lines B and C, a third dwell position is between the line C and D, and the fourth dwell position is between the lines D and A.

When helically oriented bristle tufts are arranged to form a dwell position every 90° of rotation, as in FIGS. 1 and 2, the dwell positions are defined by rows of tufts having a minimum rotational spacing of 90° minus the helix rotation. In the specifically described embodiment of FIGS. 1 and 2 where the helix rotation is about 18°, the rotational spacing of the rows forming each dwell position, e.g., the minimum rotational or angular spacing between tufts 30*a* and 30*b*, is about 72°. The same minimum rotational spacing exists for the dwell positions between lines B and C, C and D, and D and A.

Figure 3:
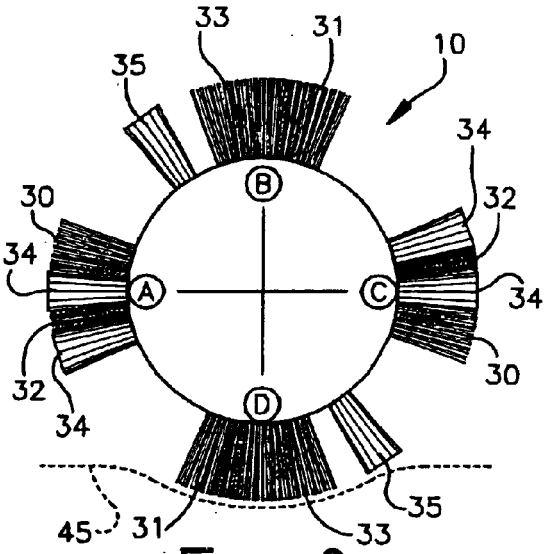
FIG. 3 is an end view showing the embodiment of FIG. 1 in one position of rotation.
Figure 4:
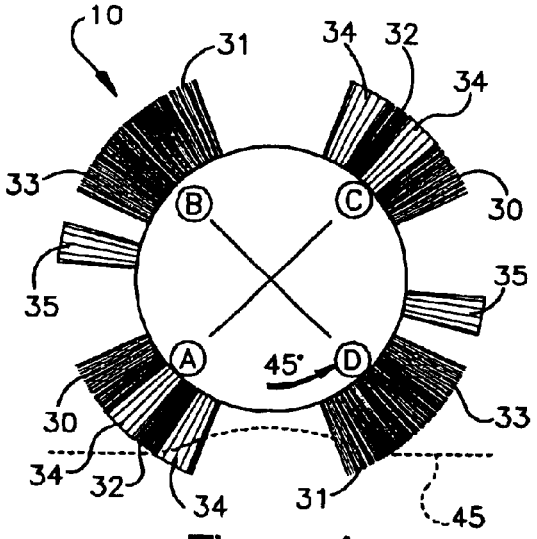
FIG. 4 is an end view showing the embodiment of FIG. 1 in a second position of rotation.
Figure 5:
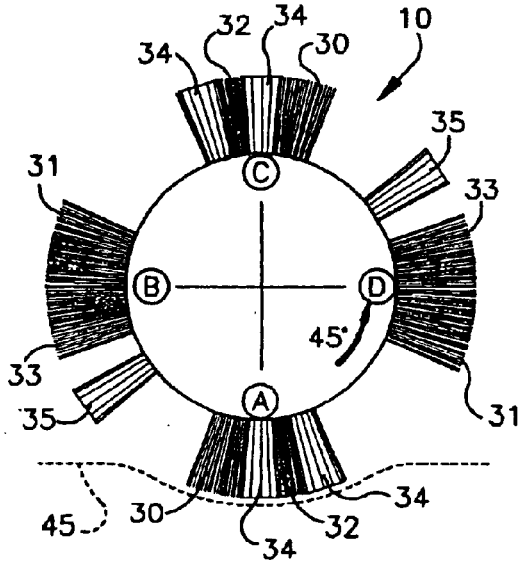
FIG. 5 is an end view showing the embodiment of FIG. 1 in a third position of rotation.
Figure 6:
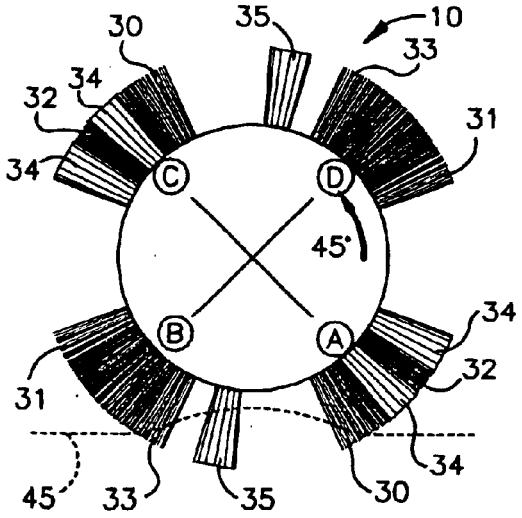
FIG. 6 is an end view showing the embodiment of FIG. 1 in a fourth position of rotation.

FIGS. 3–6 illustrate different rotations positions of the spindle 11. In FIG. 3, the bristle rows 31, 33 along the line D of FIG. 2 are in sweeping contact with the carpet 45. When the brushroll is rotated 45° as shown in FIG. 4, the dwell position between line A and B allows the carpet 45 to be drawn upwardly toward the mouth of the nozzle (not shown). Continued rotation of 45° to the position of FIG. 5 brings the bristle rows 30, 32 along the line A into sweeping contact with the carpet. When the brushroll is rotated 45° from the position of FIG. 5 to the dwell position between lines A and B illustrated in FIG. 6, the rows of bristles between lines A and B are not in sweeping contact with the carpet 45 so that it can be drawn upwardly. It will be understood that continued rotation in the indicated direction of FIGS. 3–6 brings the bristles rows 31, 33 along line B into sweeping contact with the carpet followed by a fourth dwell position between lines B and C.

Figure 7:
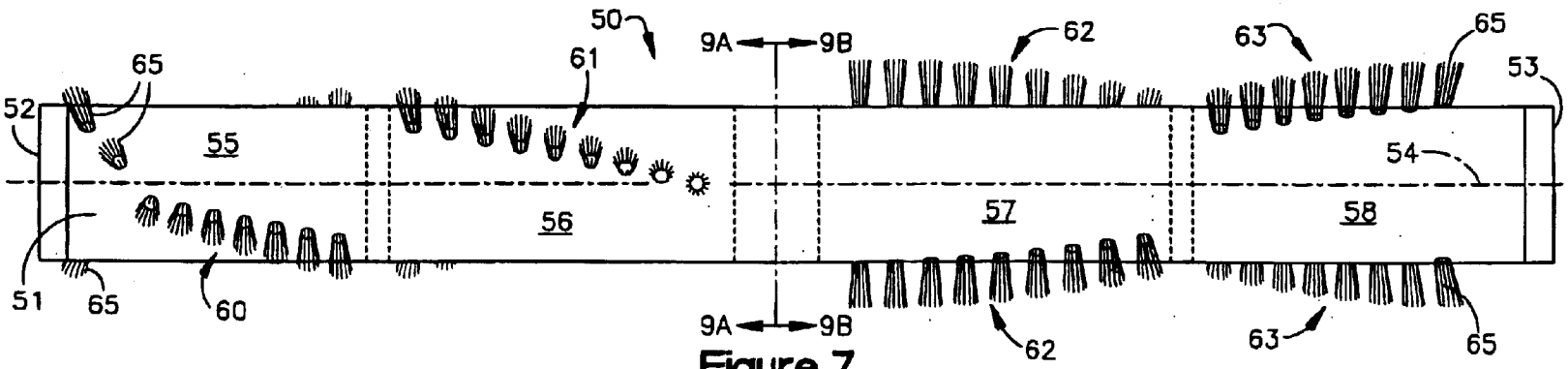
FIG. 7 is a plan view of another embodiment of the invention.
Figure 8:
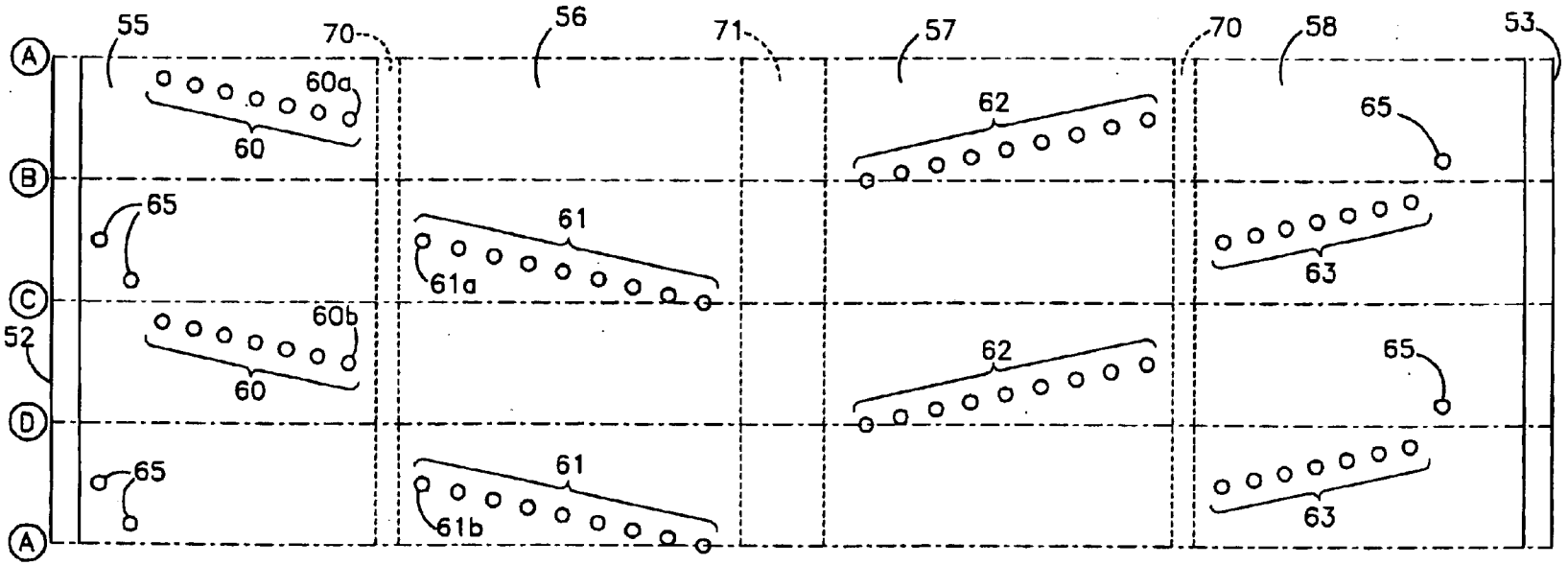
FIG. 8 is a schematic layout of the embodiment of FIG. 7 in an unrolled condition.

Referring to the embodiment shown by FIGS. 7 and 8, the brushroll is generally indicated by reference numeral 50. The brushroll 50 includes a spindle 51 having a first end 52, a second end 53, and a longitudinal axis of rotation 54. Bristle tufts on the spindle define four quadrants 55–58. The location of the bristle tufts are represented by circles in the schematic of FIG. 8.

The rows of bristle tufts in the quadrant 55 are designated by reference numeral 60, the rows in quadrant 56 by reference numeral 61, the rows in quadrant 57 by reference numeral 62 and rows in quadrant 58 by reference character 63. At the ends of the rows 60 near the spindle end 52 are two conventional tufts 65 which are similar to the tufts 34 in FIGS. 1 and 2, and are provided to guard against threads and other debris from entering the brushroll bearings (not shown). Two similar tufts 65 are provided at ends of the rows 63 near the spindle end 53. The rows 60, 61 extend in one helical direction toward the midpoint of the spindle 51, while the rows 62, 63 extend in a reverse helix direction toward the mid point of the spindle.

In the embodiment of FIGS. 7 and 8, each row 60 has a helix rotation of about 27°. Each row 61 has a helix rotation of about 40°. The rows 62 have a helix rotation of about 43°, and the rows 63 have a helix rotation angle of about 24°.

In accordance with the invention, the bristle rows of each quadrant are rotationally spaced from the bristle rolls of adjacent quadrants. In the embodiment of FIGS. 7 and 8, beginning at the end 52, the first tuft 61*a* of one row 61 is rotationally space 79° from end tuft 60*a* and 101° from end tuft 60*b*, respectively. End tuft 61*b* is rotationally spaced 79° and 101° from end tufts 60*b* and 60*a*, respectively. The last tufts in rows 61 are rotationally spaced from the first tufts of rows 62 by about 90°. The last tufts of rows 62 and the first tufts of rows 63 are rotationally spaced in the same manner as the corresponding tufts in rows 60, 61.

Figure 9A:
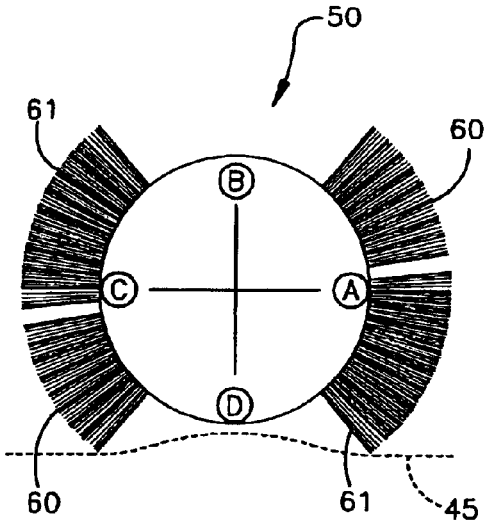
FIG. 9A is a cross-sectional view taken along the lines 9A—9A of FIG. 7.
Figure 9B:
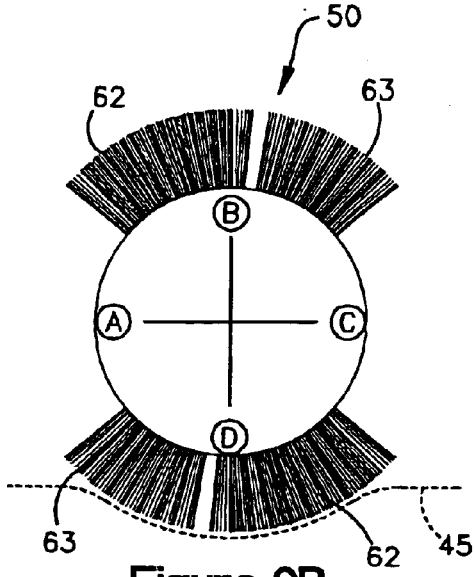
FIG. 9B is cross-sectional view taken along the lines 9B—9B of FIG. 7.
Figure 10A:
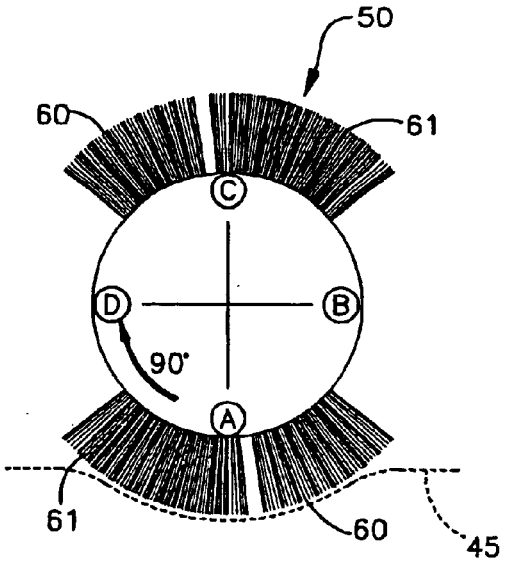
FIG. 10A is a cross-sectional view similar to FIG. 9A, but with the brushroll rotated 90°.
Figure 10B:
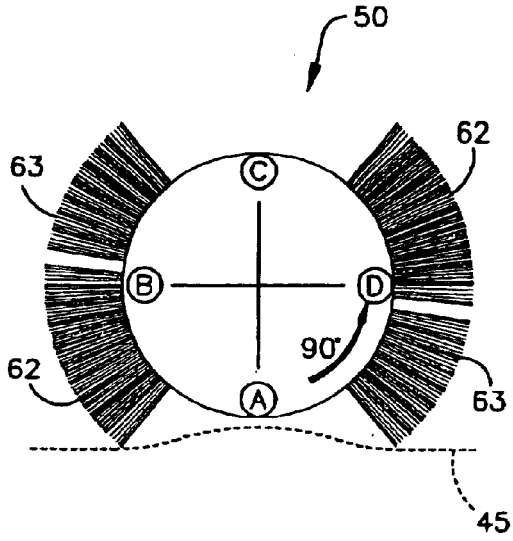
FIG. 10B is a cross-sectional view similar to FIG. 9B, but with the brushroll rotated 90°.

The helix rotation of the rows of tufts and the rotational spacing between tufts in adjacent quadrants from four dwell positions 90° apart. Two dwell positions rotationally spaced 180° extend each half of the brushroll 50. As shown in FIG. 8, two dwell positions are formed along lines B and D from the end 52 to the midpoint of the brushroll. These dwell positions are illustrated in FIG. 9A. Two more dwell positions are located along the lines A and C from the midpoint of the brushroll to its end 53. The dwell positions A, C on the right side of the brushroll as viewed in FIG. 8 are rotationally spaced 90° from the dwell positions B, D on the left side of the brushroll as viewed in FIG. 8. During the dwell position along line D which is illustrated in FIG. 9A, the rows of bristle tufts 62, 63 along the other half of the brushroll will be in sweeping contact with the carpet 45, as illustrated in FIG. 9B. When the brushroll is rotated to bring the rows 60, 61 into sweeping contact with the carpet 45, as illustrated in FIG. 10A, a dwell position exist along line A on one-half of the brushroll as illustrated in FIG. 10B.

As in the case of the first embodiment of FIGS. 1 and 2, the tuft rows which define adjacent quadrants can be axially spaced apart to provide spaces for cord savers and a belt guard. In FIGS. 7 and 8, the spaces for accommodating belt guards are indicated by reference numeral 70, and a space at the center or midpoint of the brushroll for accommodating a belt guard is indicated by reference numeral 71.

Figure 11:
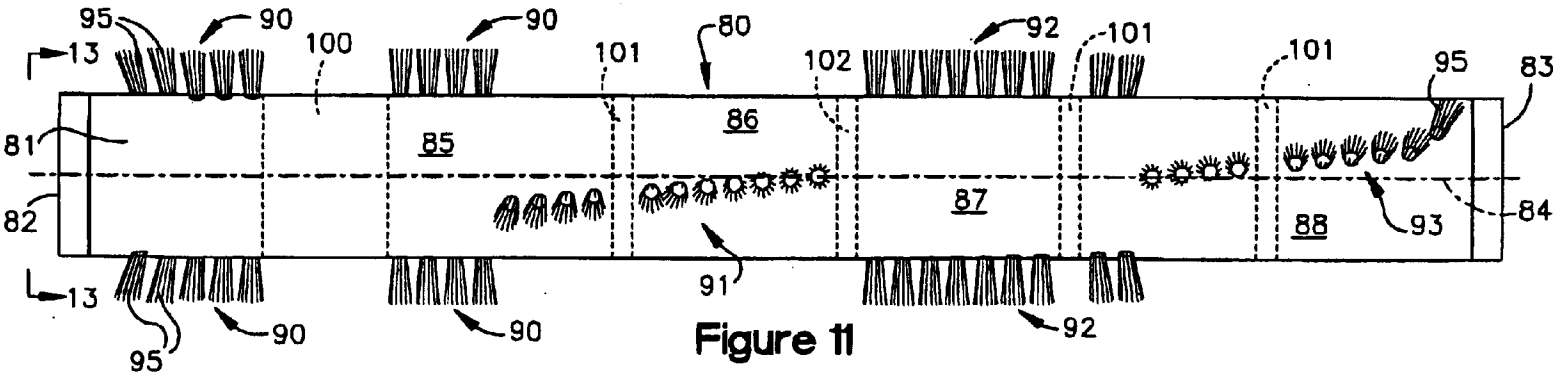
FIG. 11 is a plan view of a third embodiment of the invention.
Figure 12:
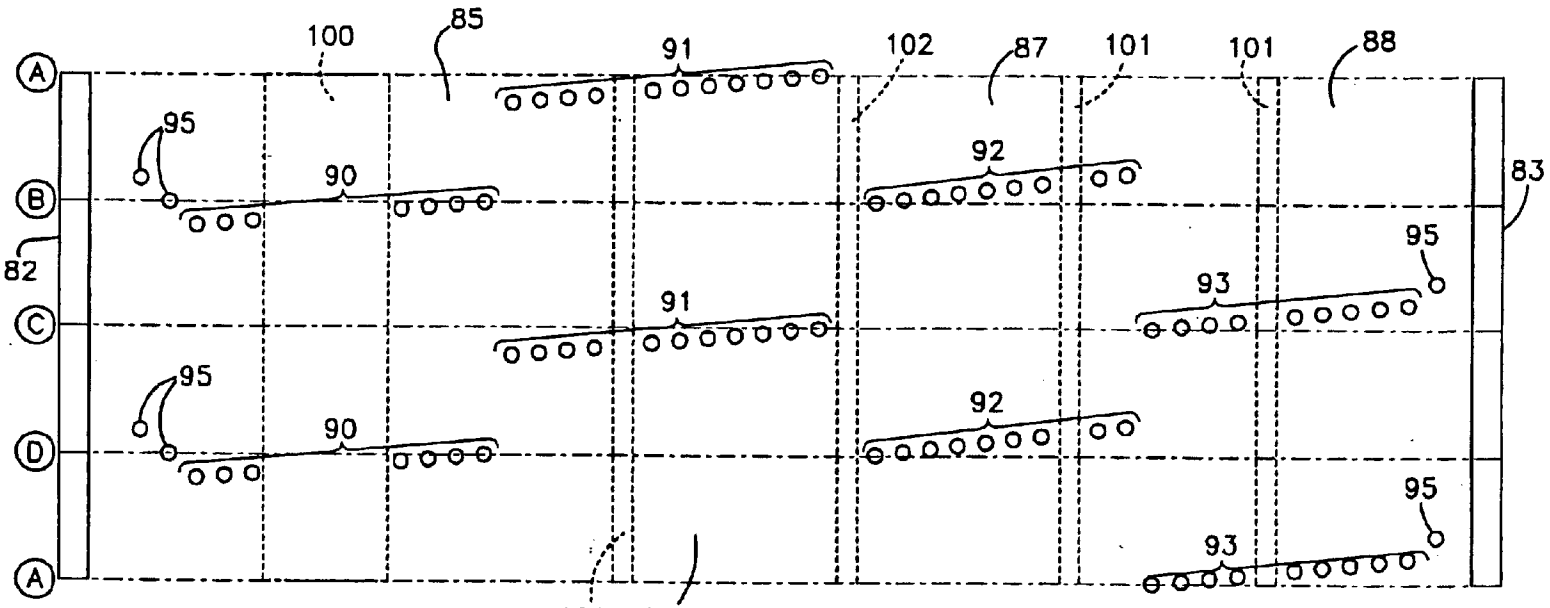
FIG. 12 is a schematic layout of the embodiment of FIG. 11 showing it in an unrolled condition.
Figure 13:
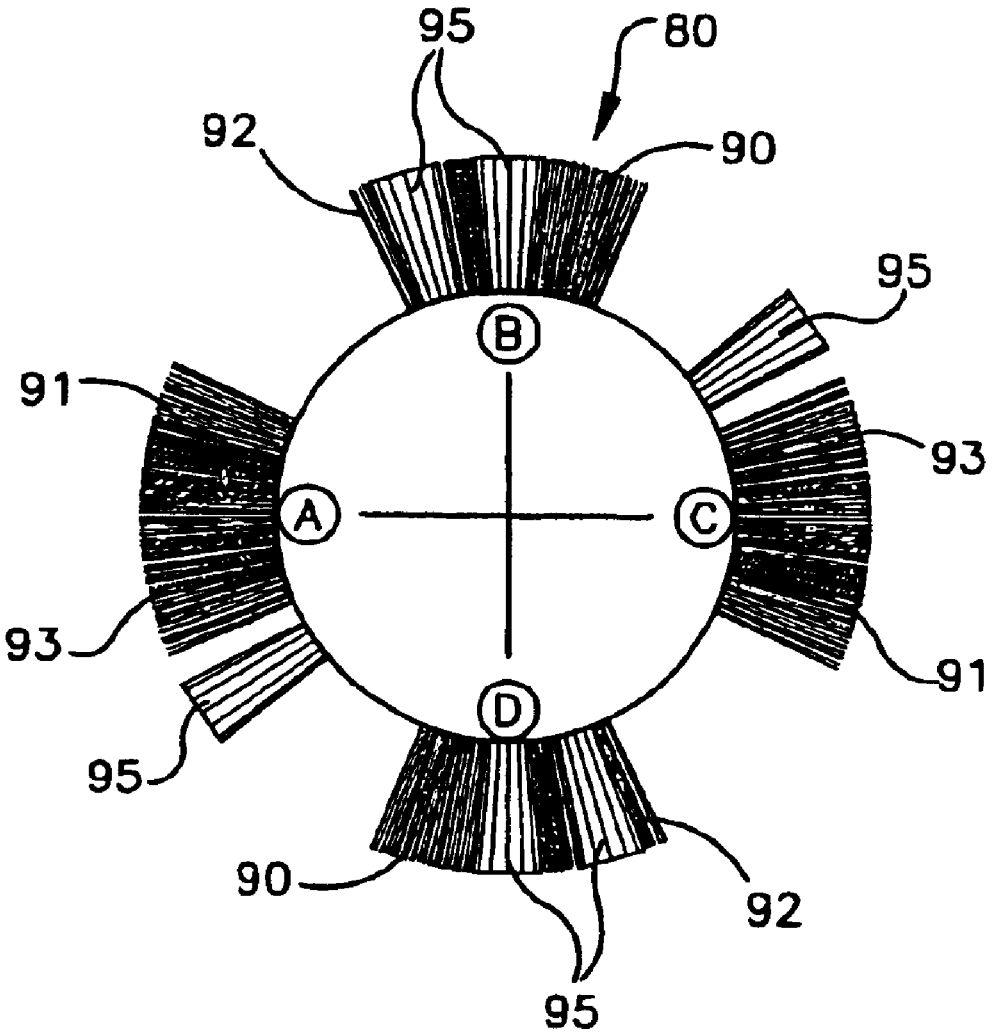
FIG. 13 is an end view taken along the lines 13—13 of FIG. 11.

The embodiment of the invention illustrated in FIGS. 11–13 is similar to that of FIGS. 1 and 2 except for the number of tufts in the rows and the spacing to accommodate belt guards and a belt guard . In FIGS. 11–13, the brushroll is generally indicated by reference numeral 80. The brushroll 80 includes a spindle 81 having a first end 82, a second end 83 and a axis of rotation 84. Bristle tufts on the spindle 81 are arranged to define four quadrants 85, 88. The tufts in each quadrant form two helically orientated rows rotationally spaced 180° apart. The two rows in quadrant 85 are indicated by reference numeral 90, the two rows in quadrant 86 by reference character 91, the two rows in quadrant 87 by reference character 92, and the two rows in quadrant 88 by reference character 93. At the ends of the rows 90 adjacent the end 82, are two conventional tufts 95 similar to the previously described tufts 34 in the embodiment of FIGS. 1 and 2. Another conventional tuft 95 is provided at the ends of each row 93 adjacent the spindle end 83. The tufts 95, adjacent to spindle end 83, are similar to the tufts 35 in the embodiment of FIGS. 1 and 2.

In the embodiment of FIGS. 11 and 12, the tuft rows 90–92 have a helix rotation of about 18°, while the rows 93 have a helix rotation of about 15°. It is to be understood that the amount of helix rotation can be varied as desired, although it is believed that a helix rotation of 45° or less is necessary to obtain effective dwell positions.

As in the other described embodiments, the tufts in the rows of adjacent quadrants are rotationally spaced apart. In the specifically illustrated embodiment of FIGS. 11 and 12, the rotational spacing is the same as described in connection with FIGS. 1 and 2.

In the embodiment of FIGS. 11 and 12, tufts in the rows 90 are eliminated to provide a space 100 for a belt guard. Tufts in the rows 91, 92 and 93 are eliminated to provide spaces 101 for cord guards. The end tufts of rows 90, 91 and 92, 93 are not longitudinally spaced, as distinguished from the previously described embodiments. The end tufts of rows 91, 92 are axially spaced to provide a belt guard space 102.

The helix rotation of the rows 90–93 and the angular spacing between the end tufts of the rows of adjacent quadrants provide four dwell positions 90° apart extending the length of the brushroll. The dwell positions are the same as described in connection with the embodiment of FIGS. 1 and 2. These dwell periods are illustrated by the end view of FIG. 13.

It will apparent from the foregoing that each embodiment of the invention provides for multiple dwell positions during brushroll rotation. The dwell positions extend for at least one-half of the length of the brushroll, and, more preferably, for the full length. Each dwell position allows the carpet to be drawn upwardly toward the mouth of the vacuum cleaner nozzle, thereby promoting up and down movement of the carpet in addition to the normal sweeping action that occurs upon brushroll rotation. The up and down movement of the carpet enhances the cleaning capability of the disclosed brushrolls of the invention.

Many other modifications and variations of the invention will be apparent to those skilled in the art in light of the foregoing detailed description and drawings. Therefore, it is to be understood that, within the scope of the appended claims, the invention can be practiced otherwise than as specifically disclosed.

What is claimed is:

1. A vacuum cleaner brushroll comprising:

a) a spindle having first and second ends and a longitudinal axis of rotation, b) bristle tufts on said spindle arranged in sections along its length, c) said bristle tufts in each section forming angularly spaced, helical rows, and d) said rows of each of said sections being angularly spaced from the rows of adjacent sections to form dwell positions around said spindle, wherein the bristle tufts along at least one half the length of the brushroll will be out of sweeping contact in each dwell position.

2. The brushroll as claimed in claim 1 wherein each of said sections has at least two angularly opposed rows of tufts.

3. The brushroll as claimed in claim 2 wherein the helix rotation of each of said rows is 45° or less.

4. The brushroll as claimed in claim 3 wherein the angular spacing of the rows of tufts of adjacent sections is no less than 90° minus the helix rotation of said rows.

5. A vacuum cleaner brushroll comprising:

a) a spindle having first and second ends and a longitudinal axis of rotation, b) bristle tufts on said spindle arranged in sections along its length, c) said bristle tufts in each section forming two helically oriented rows, d) each of said rows having a helix rotation of about 45° or less, and e) said rows of each section being angularly spaced from the rows of adjacent sections to form a plurality of dwell positions around said spindle, wherein the bristle tufts along at least one half the length of the brushroll will be out of sweeping contact in each dwell position.

6. The brushroll as claimed in claim 5 wherein there are first, second, third and fourth sections.

7. The vacuum cleaner brushroll as claimed in claim 6 wherein a) each of said rows of said first section have end tufts adjacent said second section, b) each of said rows of said second section have first tufts adjacent said first section and last tufts adjacent said third section, c) said last tufts of said rows of said first section being angularly spaced about 72° and 108° from said first tufts of said rows of said second section, d) each of said rows of said third section having first tufts angularly spaced about 90° from the last tufts of said rows of said second section, and last tufts adjacent said fourth section, e) wherein said rows of tufts of said fourth section have first tufts angularly spaced about 72° and 108° from the last tufts of said third section, and f) wherein there is a dwell position every 90° of rotation wherein the bristle tufts along at least one half the length of the brushroll will be out of sweeping contact in each dwell position.

8. The brushroll as claimed in claim 5 or claim 6 wherein each section has at least two diametrically opposed rows of tufts.

9. The vacuum cleaner brushroll as claimed in claim 5 wherein all of said rows have the same direction of helix rotation, and wherein said plurality of dwell positions include four dwell positions.

10. The vacuum cleaner brushroll as claimed in claim 9 wherein said helix rotation is in a range of from about 15° to 20°.

11. The vacuum cleaner brushroll as claimed in claim 5 wherein the rows on one-half of said spindle have the same direction of helix rotation, and the rows on the other half have a reverse direction of helix rotation.

12. The vacuum cleaner brushroll as claimed in claim 11 wherein said helix rotation is in a range of from about 20° to 45°.

* * * * *